US006843014B1

(12) United States Patent
Aponte et al.

(10) Patent No.: US 6,843,014 B1
(45) Date of Patent: Jan. 18, 2005

(54) WEAPON INHIBIT USING NITINOL WIRE

(75) Inventors: Sergio J. Aponte, Paterson, NJ (US); Clinton D. Fischer, Budd Lake, NJ (US); Louis E. Schnibbe, Ringwood, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 26 days.

(21) Appl. No.: 10/604,596

(22) Filed: Aug. 1, 2003

Related U.S. Application Data

(60) Provisional application No. 60/319,441, filed on Aug. 1, 2002.

(51) Int. Cl.[7] ..... F41A 17/00

(52) U.S. Cl. ..... 42/70.06; 42/70.11

(58) Field of Search ..... 42/70.06, 70.11

(56) References Cited

U.S. PATENT DOCUMENTS 5,946,840 A * 9/1999 Mickel ..... 42/70.11
6,735,897 B1 * 5/2004 Schmitter et al. ..... 42/70.01

* cited by examiner

*Primary Examiner*—Aileen B. Felton
*Assistant Examiner*—M. Thomson
(74) *Attorney, Agent, or Firm*—John F. Moran

(57) ABSTRACT

A shape memory alloy serves to actuate or inhibit the function of a semi-automatic pistol in response to an identification signal produced by an identifier. The identifier operates to either detect the present or absence of an authorized user thereby enabling or disabling the function of the weapon.

4 Claims, 2 Drawing Sheets

WEAPON INHIBIT USING NITINOL WIRE

CROSS REFERENCE TO RELATED APPLICATIONS

This application claims benefit under 35 USC 119(e) of provisional application 60/319,441, filed Aug. 1, 2002, the entire file wrapper contents of which provisional application are herein incorporated by reference as though fully set forth at length.

FEDERAL RESEARCH STATEMENT

This invention described herein may be made, used, or licensed by or for the United States Government for Government purposes without the payment of any royalties thereon or therefore.

BACKGROUND OF INVENTION

The present invention relates to fire arms safety, and more particularly, this invention relates to a disabling or an inhibit arrangement for weapons, such as personal weapons, which renders the weapon unusable unless predetermined identification indicia of its authorized user are satisfied. The invention also is able to operate conversely wherein the weapon is placed in an operating mode by the arrangement.

Over concern of the number of deaths caused by fire arms, such as personal small arms, from accidental shootings and unauthorized use of law enforcement arms against their authorized users in certain situations, there is a clear need for an arrangement in such weapons enabling use only by authorized personnel.

Such concerns as entailed in the use of firearms in civilian settings by unauthorized people, e.g. firearms stolen, or the unsupervised use by minors, are examples of situations with violent and/or tragic outcomes.

Such an arrangement should employ a variety of technologies rather than a unitary approach. It will comprise a family of electronic and/or mechanical devices whereby firearms possessed by users are afforded the benefit of new and emerging technologies in rendering such arrangements reasonably safe from unauthorized use.The arrangement will include either (1) a user recognition capability, one in which the arrangement augments the existing safety arrangement and enables the firing of the weapon by only the designated user(s), or (2) a locking device whereby the firearm is accessible only to those possessing a key, code, or other enabling identification methodology.

Presently firearms are useable by whoever possesses them. This includes violent perpetrators, hapless children, and the unskilled curious. Since firearms have as a central part of their object the killing or destruction of a target (often legitimately warranted), the implementation of any safety technology should not obviate or significantly impair the primary function of the firearm. Safety features have traditionally been a component part of firearm physical architecture. Therefore, the augmentation of mechanical and/or electronic safety devices continues as an improvement in firearm safety.

Such an arrangement shall be operable in the same scenarios (law enforcement and civilian), as are presently owned firearms. This includes all current terms and conditions of firearms usage and environmentally driven conditions. The performance, capabilities and characteristics of an inhibit arrangement are as follows:(1) The user-only small arms arrangement performance will either interrupt the firing capability of the firearm by electronic or mechanical means should an unauthorized user take possession of the firearm. The arrangement must rapidly and accurately be able to positively identify the authorized User(s) and deny use to all others.

The arrangement should provide, as a threshold, the authorized user(s) the capability to employ the firearm in a timely manner (equal to or better than existing firearms).

It is important that the arrangement configuration have a size and weight which will not inhibit, or cause undue hardship for, the authorized user(s).

Capabilities of such an arrangement required may have application within the military especially in areas such as operations other than war and law enforcement and/or peacekeeping missions (e.g. for the disabling of lost or stolen weapons, and/or the identification of friend or foe). For the law enforcement application, the arrangement will offer the potential to mitigate the effects of incidences in which the law enforcement official has their weapon forcibly taken from them and used against their person and/or fellow personnel or innocent bystanders. Additionally, the arrangement will help alleviate firearm safety deficiencies involving the misuse of civilian sector firearms by children or other unauthorized personnel.

Such an arrangement will employ a variety of technologies rather than a unitary approach. It will comprise a family of electronic and/or mechanical devices whereby firearms possessed by users are afforded the benefit of new and emerging technologies in rendering such arrangements reasonably safe from unauthorized use.The arrangement will include either (1) a user recognition capability, one in which the arrangement augments the existing safety arrangement and enables the firing of the weapon by only the designated user(s), or (2) a locking device whereby the firearm is accessible only to those possessing a key, code, or other enabling and identifying methodology.

The law enforcement community (Federal, state, and local) routinely carry on their person, and/or store, small arms as part of their daily activities. Law enforcement officers must be prepared to respond to a variety of crises, during which there is the ever-present possibility that their firearm might be forcibly taken from them. In this incidence, the automatic deactivation of their firearm (once it is separated from their authorized user) is key to survival during armed encounters. As regards the private ownership of firearms, technologies might be able to render the firearm a safer arrangement than is presently the case, but cannot replace the cognitive functions and the judgment of the operator. Moreover, the imposition of technological driven safeties must not be perceived as a replacement for firearm training and/or responsible behavior on the part of any firearm owner. Private firearm ownership entails a wide variety of traditional usages (e.g. hunting, target shooting, collecting, and self-defense), the mode entailing the greatest extremes shall be the metric for determining reliability: self-defense.

Law enforcement personnel are tasked to perform non-tactical routine activities, although these tend to be specific in nature, they can involve encounters with violent "suspects who shoot". When involved in such confrontations, the law enforcement officer may have their firearm taken away by the suspect with a better than 40–60% chance that the suspect will attempt to shoot the law enforcement officer.

The following information is applicable to both law enforcement and civilian operations. The mean-rounds-between-failure will not be less than the unencumbered firearm itself. Overall the arrangement reliability should be demonstrated at a high confidence level. The arrangement will be capable of effective employment under harsh environmental conditions. This includes extremes of temperature, moisture, contaminants, and visibility. The operation of the arrangement cannot be degraded by any of these environmental conditions to the point that it cannot be effectively employed for its intended purpose. The arrangement will be required to operate in environments where temperatures may vary from 40 degrees to 130 degrees Fahrenheit. Operations within this threshold temperature range must also successfully contend with direct exposure to hazardous weather conditions (e.g., rain, snow, mud, salt water immersion, salt fog exposure, solar radiation, etc.).

SUMMARY OF INVENTION

The present invention employs the use of shape memory alloy wire (also referred to as Muscle wire) to stop the function of a semi-automatic pistol. Once a signal is received from a discriminatory arrangement which analyzes and determines if person is permitted to shoot the weapon, the Nitinol wire either stays the same to maintain operation or contracts to make the weapon non-functional.

In another aspect of the invention, the shape memory alloy wire may be deployed to be activated by an electrical signal or current in order to make the weapon operational. The electrical signal or current is generated by apparatus which recognizes the personal indicia of the authorized user. Typically the personal indicia may be based on their finger print, although other indicia may be readily used including external means such as a security card personally issued to the authorized user.

DETAILED DESCRIPTION

Figure 1:
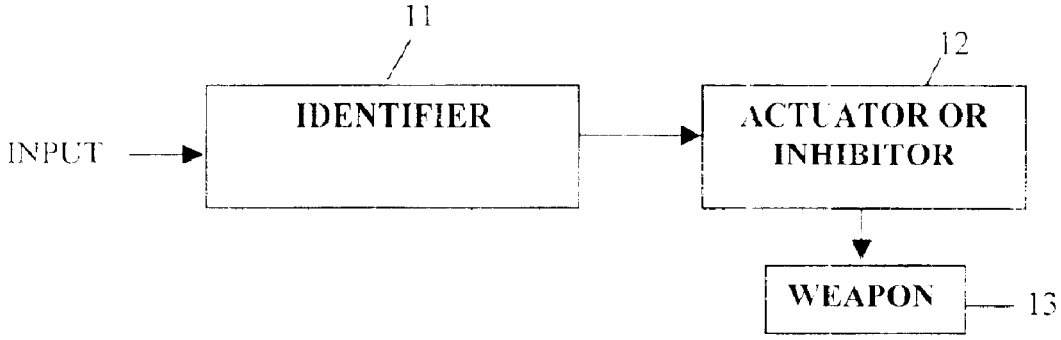
FIG. 1 is a block diagram illustrating the basic arrangement of the invention.

In one application of this invention involves an M9 Semi-automatic Pistol. This weapon requires 24 in.-lbs of energy to ignite its primer for firing. This energy is transmitted through a combination of trigger, hammer release lever, trigger bar, hammer spring, strut, hammer and ultimately the firing pin. To stop the weapon function at least one of these parts must be made inoperable. In this case the trigger bar is lowered with the contraction of the Nitinol wire causing the weapon to act as if it were in safe mode. The hammer release lever is not operated and the weapon becomes non functional.

Nitinol is the proper name for shape memory alloy actuator wires. It was invented in 1962 by the U.S. Naval Ordnance Laboratory, who were seeking a corrosion resistant alloy. In the process, they discovered a shape memory alloy (Nitinol is an acronym for "Nickel Titanium Naval Ordnance Laboratory") comprising an alloy of 55% nickel and 45% titanium. Its operation resembles that of a muscle; it contracts when heated. At such times when a current is passed through the wire actuator it heats the wire electrically (ohmic heating). When the current is removed, it cools and can easily be stretched back it its original length. It should be noted this process is the opposite of thermal expansion. In addition the thermal movement (contraction-expansion) is a hundred fold greater than that of typical standard metals.

One of the advantages of this arrangement is that Nitinol has very high corrosion resistance, making it the better choice for environments where motors would fail due to wear and corrode.

Another advantage is that Nitinol's movement via molecular restructuring is both electrically and acoustically quiet.

A further advantage is that Nitinol wires are inexpensive while easily integrating into many applications.

There is a size advantage because Nitinol actuator wires are by far smaller than the alternatives (at least 1,000 times smaller than motors and solenoids for the same work done).

Another advantage is that Nitinol wire is that it directly interfaces with existing mechanisms, eliminating the need for gear boxes, housings, bearings, etc.; making Nitinol the much easier alternative to work with M9 Function Inhibition Nitinol "muscle wire" is used to impede energy transfer needed to fire the weapon.

To achieve inhibition the Trigger Bar is lowered through ohmically (electrically) heating the Nitinol wire causing it to contract and stopping the trigger from operating the hammer (please see below.) Nitinol generates a shape resuming force of 22,000 pounds per square inch. In a typical case 0.008" diameter wire is used and creates a contractive force of 590 grams (1.3 lbs.) at 0.5 amps. Speed and strength of the wire contraction determine how fast and how high the wire temperature is increased. The wire is kept at or below 0.6 amps at room temperature in order to avoid burn-out or destruction of the wire.

FIG. 1 is a block diagram illustrating the basic arrangement of the invention. In FIG. 1 the input of the authorized user is provided to identifier 11 which provides a signal or electrical current for actuator or inhibitor 12 which is deployed to interface with weapon 13. This arrangement may be designed to operate in either of two modes. In a first mode of operation, identifier 11 serves to validate the input of an authorized user wherein actuator 12 serves to activate weapon 13 so that it may be operated by the authorized user. In a second mode of operation, block 12 functions as an inhibitor to prevent the operation of weapon 13 when identifier 11 indicates its input is not being provided by the authorized user. For example, the use of weapon 13 in a civilian setting may be prohibited unless the input to identifier 11 is provided by an authorized user. In a military setting, it may be desirable for weapon 13 to be operational normally until the presence of an aunuthorized user is detected by identifier 11.

Figure 2:
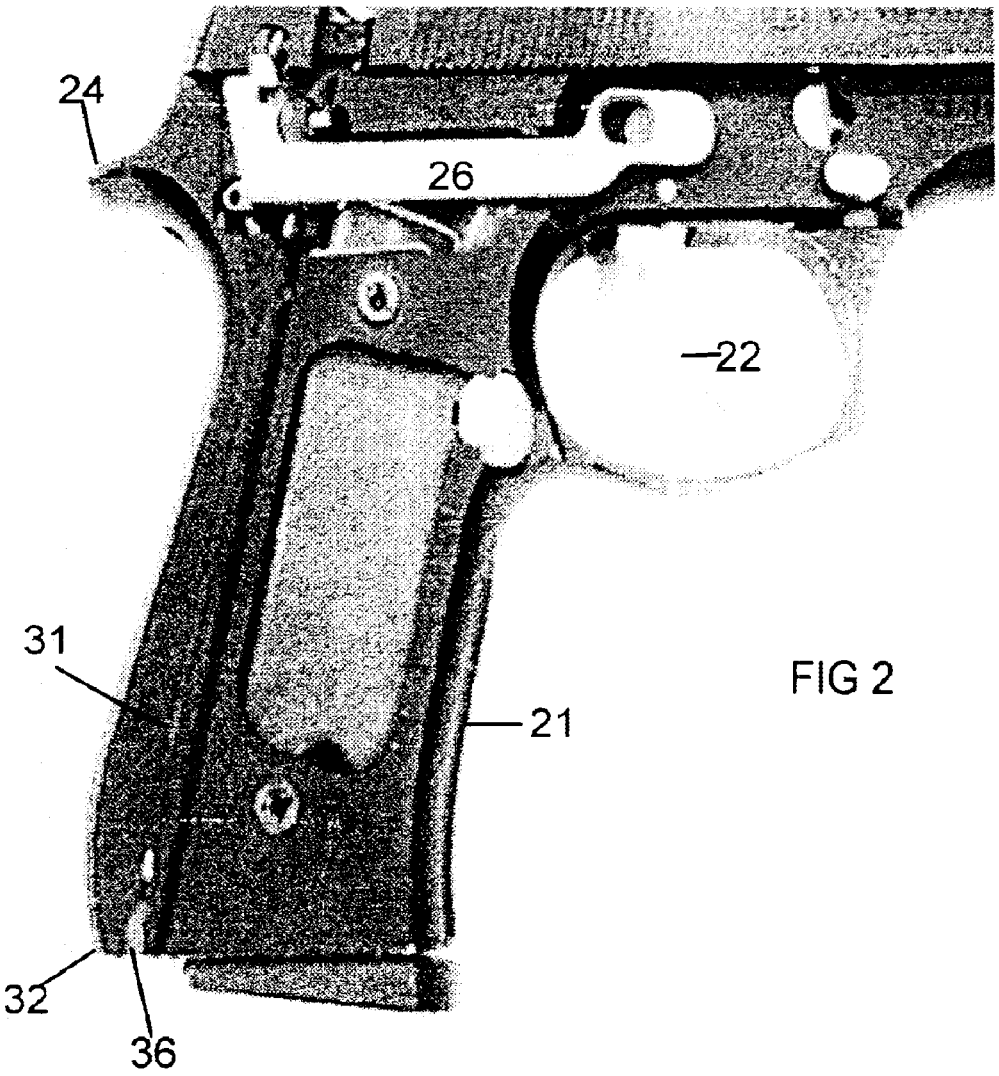
FIG. 2 illustrates a typical semiautomatic weapon, such as an M9 semiautomatic pistol, wherein a portion of its firing mechanism is exposed

FIG. 2 illustrates a typical semiautomatic weapon 21, such as an M9 semiautomatic pistol, wherein a portion of its firing mechanism is exposed extending generally above trigger 22 back to hammer 24. Typically, energy generated b pulling trigger 22 is transmitted by the firing mechanism back to hammer 24. For the M9 weapon, the firing mechanism includes besides trigger 22 and hammer 24, a hammer release lever, a trigger bar, a hammer spring, a strut, and finally a firing pin directly activated by hammer 24. Of these component parts of the firing mechanism, only trigger bar 26 is clearly visible in FIG. 2, since the other components are internal within weapon 21.

Present on the weapon is wire actuator 31 which extends from trigger bar 26 to the bottom portion of handle 32. At this extreme end of actuator 31 an electrical connector 36 is located to receive a signal or current which is conducted along actuator 31 which comprises nitinol and heats up contracting to lower trigger bar 26 downward to inhibit and deactivate weapon 21. Actuator 31 may be readily deployed to interface with any other appropriate component in the firing mechanism to obtain a similar result. In this case of a semiautomatic pistol, the most common component is trigger bar 26.

In an alternative arrangement, actuator 31 may be deployed to raise the trigger bar upward to serve to activate weapon 21 only when an authorized user is detected by identifier 11.

What is claimed is:

1. A safety arrangement for a weapon including a firing mechanism having a trigger bar, the safety arrangement comprises:

means for disabling the trigger bar comprising a shape memory alloy member deployed to move the trigger bar in a predetermined direction, the trigger bar being moved in said direction when a current is received by the alloy member in response to the absence of an authorized user.

2. The safety arrangement of claim 1 wherein said shape memory alloy is nitinol.

3. A safety arrangement for a weapon including a firing mechanism having a trigger bar, the safety arrangement comprises:

means for activating the operation of the trigger bar enabling operation of the weapon, comprising an actuator for moving the trigger bar in a second direction, the actuator comprising a shape memory alloy member adapted to receive an electrical signal whereby the actuator contracts and moves the trigger bar in said second direction to enable operation of the weapon.

4. The safety arrangement of claim 3 wherein said actuator comprises nitinol alloy.

* * * * *